United States Patent [19]

Smith

[11] Patent Number: 5,052,140

[45] Date of Patent: Oct. 1, 1991

[54] GUN MAGAZINE ENTRANCE GUIDE ACCESSORY

[76] Inventor: Alan K. Smith, 113 LaFawn Cir., Garland, Tex. 75043

[21] Appl. No.: 592,244

[22] Filed: Oct. 3, 1990

[51] Int. Cl.[5] ..... F41C 27/00

[52] U.S. Cl. ..... 42/7

[58] Field of Search ..... 42/7, 90

[56] References Cited

U.S. PATENT DOCUMENTS

| | | | |
|---|---|---|---|
| 3,069,976 | 12/1962 | Stevens, Jr. | 42/7 |
| 3,999,321 | 12/1976 | Musgrave | 42/7 |
| 4,520,585 | 6/1985 | Barrett | 42/7 |
| 4,570,370 | 2/1986 | Smith et al. | 42/7 |

*Primary Examiner*—Charles T. Jordan

*Attorney, Agent, or Firm*—Warren H. Kintzinger

[57] ABSTRACT

A guide for the insertion of gun magazines with a mounting extension insertable into a bottom opening in the butt of the gun with a butt bottom rim receiving opening with a bottom at the back end extended to opposite side shoulders with opposite sides engaging the rim profile of the gun butt bottom when mounted in place on the gun butt. The guide forms a lower flanged out bottom of the gun butt for improved grip and presents a wide angled opening extending out wider to opposite sides than the projected profile of the gun butt bottom making it easier and faster to insert a fresh magazine into the gun receiver. This magazine entrance guide has bifurcated sides extending forward from the rear in one embodiment and in another embodiment the front end is closed with the opposite sides joined together at the front. In either form this gun magazine entrance guide is quite useful for pistols such as the GLOCK pistol (U.S. Pat. No. 4,539,889) for faster loading and improved pistol grip.

13 Claims, 1 Drawing Sheet

FIG. 1
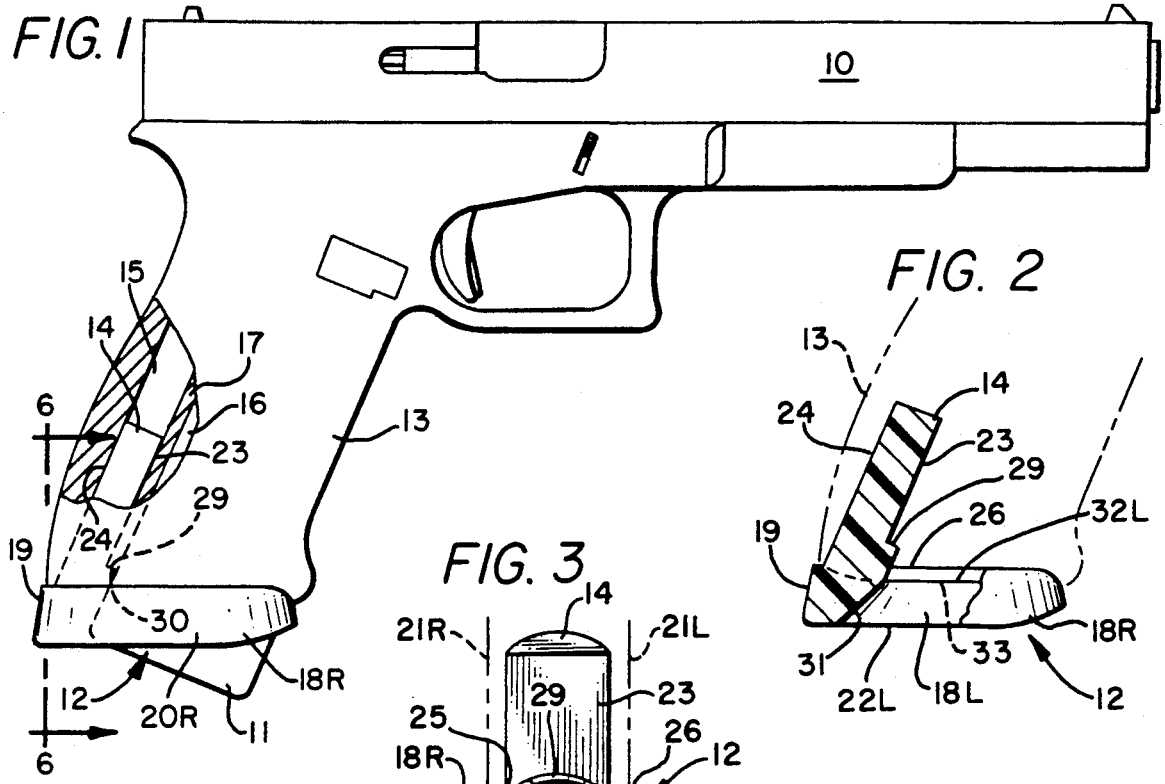
FIG. 2
FIG. 3
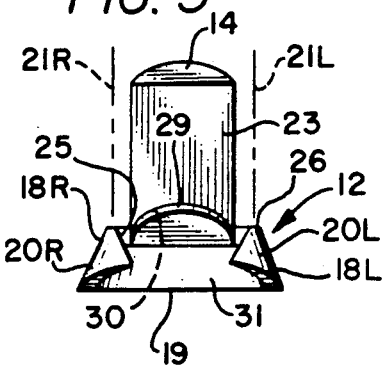
FIG. 4
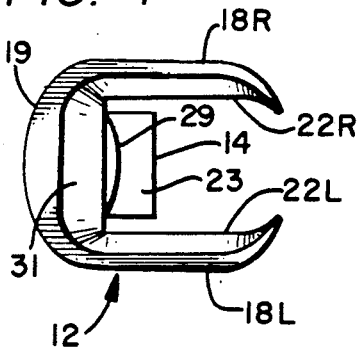
FIG. 5
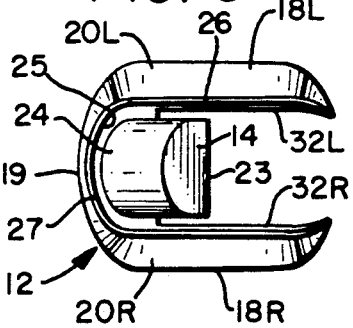
FIG. 7
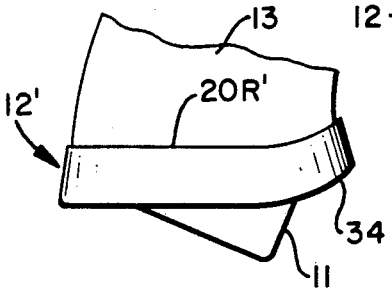
FIG. 6
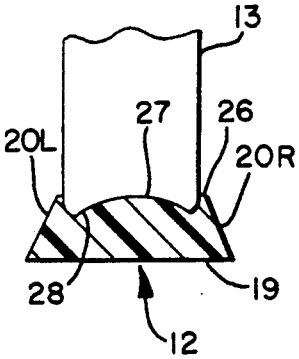
FIG. 8
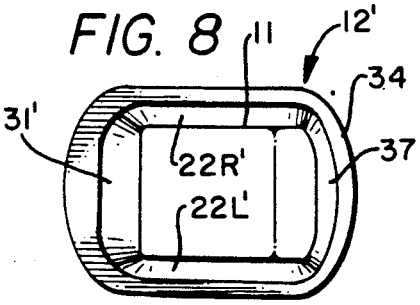
FIG. 9
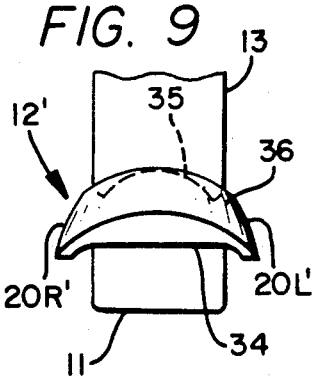

GUN MAGAZINE ENTRANCE GUIDE ACCESSORY

This invention relates in general to gun magazine entrance and grip structures, and more particularly, to an enlarged wide angled to opposite sides and to the rear opening magazine entrance guide and flanged out butt bottom improved pistol grip.

Magazine insertion in tne receiver of pistol grips is many times more difficult and slower than desired particularly under a stress situation such as in target shooting matches, law enforcement or military use. Further, through periods of rapid shooting with repeated insertion of fresh magazine clips it is important that the hand grip of the gun be stabilized for enhanced accuracy of shooting repeated rounds. These factors are enhanced if the gun grip is both lengthened and flanged out below the butt bottom and the magazine receiver is provided with a wide angled guide mouth opening for guiding fresh magazines into the gun receiver without catch, hang up or binding.

It is therefore a principal object of this invention to provide an improved magazine insertion guide to a gun receiver.

Another object is to provide such an improved magazine insertion guide that beneficially, via both lengthening and flanging outwardly to the sides at the gun butt bottom, enhances stabilty in holding of the gun.

A further object is to improve ease and speed of fresh magazine insertion in a gun receiver.

Still another object is to eliminate gun magazine insertion catch, hang up or insert binding as magazines are being changed in a gun.

Features of the invention useful in accomplishing the above objects include, in a gun magazine entrance guide accessory, a guide for the insertion of gun magazines with a mounting extension insertable into a bottom opening in the butt of the gun with a butt bottom rim receiving opening with a bottom at the back end extended to opposite side shoulders with opposite sides engaging the rim profile of the gun butt bottom when mounted in place on the gun butt. The guide forms a lower flanged out bottom of the gun butt for improved grip and presents a wide angled opening extending out wider to opposite sides than the projected profile of the gun bottom making it easier and faster to insert fresh magazine clips into the gun receiver. This magazine entrance guide has bifurcated sides extending forward from the rear in one embodiment and in another embodiment the front end is closed with the opposite sides joined together at the front. In either form this gun magazine entrance guide is quite useful for pistols such as the GLOCK pistol (U.S. Pat. No. 20 4,539,889) for faster loading and improved pistol grip.

Specific embodiments representing what are presently regarded as the best mode of carrying out the invetion are illustrated in the accompanying drawing.

In the drawing:

FIG. 1 represents the right hand side elevation view of a GLOCK semi automatic pistol with a magazine entrance guide accessory mounted at the butt bottom;

FIG. 2, a right hand broken away and sectioned side elevation view of the gun magazine entrance guide in bifurcated form with a mounting extension;

FIG. 3, a front elevation view of the gun magazine entrance guide of FIGS. 1 and 2;

FIG. 4, a bottom plan view of the gun magazine entrance guide of FIGS. 1, 2 and 3;

FIG. 5, a top plan view of the gun magazine entrance guide of FIGS. 1–4;

FIG. 6, a rear cut away and sectioned view of the gun butt bottom as it fits tne gun magazine entrance guide of FIGS. 1–5;

FIG. 7, a partial cut off side elevation view of the gun butt bottom with a magazine entrance guide having a closed front end with opposite sides joined together at the front and with a magazine inserted in place;

FIG. 8, a bottom plan view of the magazine entrance guide of FIG. 7 with a magazine inserted in place; and FIG. 9, a front elevation view of the magazine entrance guide of FIGS. 7 and 8 mounted on the bottom of a gun butt with a magazine inserted in place.

Referring to the drawing:

The semi automatic pistol 10 of FIG. 1 is shown to be equipped with a magazine 11 and a receiver opening entrance guide 12 mounted on the bottom of gun butt 13 with a mounting projection 14 extended up into gun butt opening 15. Opening 15 is to the rear from and separated from magazine receiver opening 16 by an internal wall 17. A magazine 11 fully inserted in place projects out at the bottom into the open below the magazine entrance guide 12. Referring also to FIGS. 2–6 the magazine receiver entrance guide 12 includes forwardly extended bifurcated arms 18L and 18R joined at the rear by guide back 19. Arms 18L and 18R are flange flared outwardly at oppositely directed slope angled surfaces 20L and 20R beyond the projected vertical profile sides 21L and 21R of the gun butt 13 providing a flanged out bottom for improved gun grip, and on the inner sides of the arms 18L and 18R wide angled opening downward facing sloped surfaces 22L and 22R extended out wider to opposite sides than the projected profile of the gun butt 13. The mounting projection 14 that slopes forwardly has a flat surface 23 on the front that engages and extends along the sloped back of internal wall 17, and has a rounded back surface 24, to present in transverse section a half moon shape. There is a groove 25 between the upper rim 26 of guide 12 and the rounded back surface 24 of mounting projection 14 that has an upwardly rounded convex bottom 27 that mates with the concave bottom edge 28 at the bottom rear of the gun butt 13. The front flat surface 23 is formed at the bottom with an arcuate topped shoulder 29 that fits the concave bottom edge 30 of butt internal wall 17. Guide back 19 is formed with a downward facing wide angled sloped rear surface 31 that at opposite ends curves into opposite side surfaces 22L and 22R as a further aid to magazine 11 entrance to the gun butt 13 receiver opening 16. The insides of opposite side arms 18L and 18R also have upward facing narrow shoulders 32L and 32R that engage opposite side bottom edges 33 of gun butt 13.

Referring now to the closed front end magazine receiver opening entrance guide 12' embodiment of FIGS. 7, 8 and 9 that is very much like the guide 12 embodiment of FIGS. 1–6 with the exception that the opposite side arms 18L' and 18R' are joined at the front by cross member 34. Cross member 34 is formed as an upward curved cross member so as to cover the concave cut out 35 at the front bottom of gun butt 13, and with an outer sloped flange projection 36 that blends into the slope angled surfaces 20L' and 20R' as a further aid for improved gun grip. The inside bottom of cross member 34 is also formed with a downward facing wide angled sloped front surface 37 that at opposite ends curves into opposite side surfaces 22L' and 22R' that is an additional guide aid to magazine 11 entrance to the gun butt 13 receiver opening 16.

Thus, there is hereby provided two improved gun magazine receiver entrance guide embodiments that as distinct from the wide angled gun magazine entrance guide of U.S. Pat. No. 4,570,370, issued Feb. 18, 1986 of which I am a co-inventor, does not have a mainspring housing but merely an upward sloped forward mounting projection that extends into a butt bottom opening and along the rear surface of the receiver opening rear wall. Further, the two gun magazine receiver entrance guide embodiments both are flanged outwardly to opposite aides beyond the projected opposite side profile of the gun butt. In addition, opposite side wide angled opening downward facing sloped surfaces 22L and 22R (22L' and 22R') that blend into downward facing sloped rear surface 31 (31') also extend outward to opposite sides further than the projected opposite side profile of the gun butt 13. A further distinguishing feature is the front cross connection in one embodiment including a front guide surface, and that on the front outside flanges outwardly as a further improvement for enhanced gun butt grip.

Whereas this invention has been described with respect primarily to two embodiments thereof, it should be realized that various changes may be made without departing from the essential contributions to the art made by the teachings hereof.

I claim:

1. A wide angled gun magazine entrance guide for easier and faster insertion of fresh magazines into a gun receiver comprising: a guide back base; upward extension mounting means from said guide back base insertable into and up a gun butt bottom opening located behind a magazine receiver opening rear wall in the butt; opposite side arms extended forwardly from said guide back base; said opposite side arms having flanged out to the sides opposite outer sides extending outward beyond the projected opposite side profile of the gun butt the magazine entrance guide is mounted on to form a lower flanged out bottom of the gun butt when mounted in place thereon for improved grip; and with said opposite side arms being formed with inner side wide angled opening slopes extended outwardly wider to opposite sides than the projected profile of the opposite sides of the gun butt making it easier and faster to insert a fresh magazine into the gun receiver; wherein said guide back base is formed with a downward facing beveled surface angled toward the back of the magazine receiver opening and interconnecting said inner side wide angled opening slopes of said opposite side arms through opposite end curved surfaces blended between the wide angled surfaces; said upward extension mounting means has a flat surface on the front and a rounded back surface such as to present in transverse section a half moon shape; and wherein said magazine entrance guide has a rim and there is a groove between said rim and said upward extension mounting means.

2. The wide angled gun magazine entrance guide of claim 1, wherein said magazine entrance guide is a closed front end magazine receiver opening entrance guide with said opposite side arms joined at the front by a cross member.

3. The wide angled gun magazine entrance guide of claim 2, wherein said cross member is formed at the inside bottom with a downward facing wide angled sloped surface that at opposite ends curves into said opposite side arm inner side wide angled opening slopes.

4. The wide angled gun magazine entrance guide of claim 3, wherein said cross member is formed with an outer sloped flange projection that blends at opposite ends into said arm opposite outer sides and that projects outward beyond the projected front profile of the gun butt for improved grip.

5. The wide angled gun magazine entrance guide of claim 4, wherein said cross member is an upward curved cross member.

6. The wide angled gun magazine entrance guide of claim 1, wherein said groove is between said rim and the rounded back surface of said upward extension mounting means; and with said groove having an upwardly rounded convex bottom that mates with a concave bottom edge at the bottom rear of a gun butt.

7. The wide angled gun magazine entrance guide of claim 6, wherein said flat surface on the front of said extension mounting means is formed at the base with an arcuate topped shoulder that fits the concave bottom edge of an internal wall within the butt of the gun.

8. The wide angled gun magazine entrance guide of claim 7, wherein said extension mounting means has a forward slope that matches the slope of said internal wall within the butt of the gun.

9. The wide angled gun magazine entrance guide of claim 8, wherein the insides of said opposite side arms have upward facing narrow shoulders that engage opposite side bottom edges of the gun butt.

10. The wide angled gun magazine entrance guide of claim 9, wherein said magazine entrance guide is a closed front end magazine receiver opening entrance guide with said opposite side arms joined at the front by a cross member.

11. The wide angled gun magazine entrance guide of claim 10, wherein said cross member is formed at the inside bottom with a downward facing wide angled sloped surface that at opposite ends curves into said opposite side arm inner side wide angled opening slopes.

12. The wide angled gun magazine entrance guide of claim 11, wherein said cross member is formed with an outer sloped flange projection that blends at opposite ends into said arm opposite outer sides and that projects outward beyond the projected front profile of the gun butt for improved grip.

13. The wide angled gun magazine entrance guide of claim 12, wherein said cross member is an upward curved cross member.

* * * * *